US008333606B2

(12) United States Patent
Hasegawa

(10) Patent No.: US 8,333,606 B2
(45) Date of Patent: Dec. 18, 2012

(54) ELECTRICAL CONNECTOR HAVING A TERMINAL WITH A CONNECTING SECTION AND A HELD SECTION ON TWO OPPOSITE SIDES OF A CONTACT SECTION

(75) Inventor: Yohei Hasegawa, Tokyo (JP)

(73) Assignee: Hirose Electric Co., Ltd., Tokyo (JP)

( * ) Notice: Subject to any disclaimer, the term of this patent is extended or adjusted under 35 U.S.C. 154(b) by 0 days.

(21) Appl. No.: 13/206,060

(22) Filed: Aug. 9, 2011

(65) Prior Publication Data

US 2012/0052735 A1 Mar. 1, 2012

(30) Foreign Application Priority Data

Aug. 27, 2010 (JP) ..... 2010-190696

(51) Int. Cl.
*H01R 13/62* (2006.01)

(52) U.S. Cl. ..... 439/345

(58) Field of Classification Search ..... 439/345, 439/346, 74, 751, 260
See application file for complete search history.

(56) References Cited

U.S. PATENT DOCUMENTS

| | | | | |
|---|---|---|---|---|
| 5,139,446 | A * | 8/1992 | Costello et al. | 439/751 |
| 5,885,092 | A * | 3/1999 | Ito et al. | 439/74 |
| 6,726,497 | B2 * | 4/2004 | Nogawa et al. | 439/260 |
| 7,033,189 | B1 * | 4/2006 | Zhang et al. | 439/135 |
| 7,674,115 | B2 * | 3/2010 | Midorikawa | 439/74 |
| 7,828,571 | B2 * | 11/2010 | Satoh et al. | 439/260 |
| 2011/0070752 | A1 * | 3/2011 | Yamashiro et al. | 439/83 |
| 2012/0052711 | A1 * | 3/2012 | Hasegawa | 439/345 |

FOREIGN PATENT DOCUMENTS

JP 05-217641 8/1993

* cited by examiner

*Primary Examiner* — Chandrika Prasad
(74) *Attorney, Agent, or Firm* — Kubotera & Associates, LLC

(57) ABSTRACT

An electrical connector includes a housing and terminals made of a sheet metal, which are held by the housing. The plurality of terminals is arranged in a direction perpendicular to a contact surface of a contact section thereof, and is held by the housing. Each of the terminals has a held section to be held by the housing, a contact section to contact with a mating terminal, and a connecting section to be connected to a circuit board each forming a flat sheet surface. The contact section is formed to have a flat contact surface, which slidably contacts with the mating terminal and extends in a connector fitting direction.

4 Claims, 8 Drawing Sheets

ELECTRICAL CONNECTOR HAVING A TERMINAL WITH A CONNECTING SECTION AND A HELD SECTION ON TWO OPPOSITE SIDES OF A CONTACT SECTION

BACKGROUND OF THE INVENTION AND RELATED ART STATEMENT

The present invention relates to an electrical connector having terminals made of a sheet metal. Specifically, the present invention relates to an electrical connector having terminals, in which each of the terminals has a contact section formed as a flat sheet surface and a contact section contacting with a mating terminal while the contact section slides against the mating terminal.

A convention electrical connector has been disclosed in Patent Reference. The convention electrical connector disclosed in Patent Reference has a fitting section that enters and fits into a mating fitting hole of a mating connector, and a lid to cover the mating connector after the fitting section fits into the mating fitting hole of the mating connector.

Patent Reference: Japanese Patent Publication No. 05-217641

In the convention electrical connector, the housing has a cross-section having a T-character shape formed with the fitting section and the lid in the fitting direction. Each of the terminals that form a flat surface is attached to a corresponding groove formed in the housing, and protrudes from a side surface of the fitting section to form a contact section. The side surface and a portion protruding from an upper surface of the lid form a connecting section. Accordingly, each of the terminals has the contact section and the connecting section at a front side and a rear side in the fitting direction, respectively. The housing that holds the terminals have a dimension to cover both the contact sections and the connecting sections in the fitting direction.

In the convention electrical connector disclosed in Patent Reference, a rear edge portion of the connecting section of each of the terminals may be attached to a circuit board when the convention electrical connector is used. It has been desirable for the convention electrical connector to have a small dimension in a direction that is perpendicular to a surface of the circuit board, i.e., in the fitting direction.

According to the convention electrical connector disclosed in Patent Reference, the housing has a dimension over both the contact section provided at the front side in the connector fitting direction and the connecting section provided at the rear side in the connector fitting direction. Therefore, each of the terminals has a dimension overlapping with that of the housing holding the terminals in the fitting direction, thereby increasing a size of the terminals and a size of the housing.

In addition, the terminals are pressed and fit into the corresponding grooves of the housing. Accordingly, it is necessary to increase a contact area between the housing and terminals to securely hold the terminals in the housing, thereby making it difficult to reduce the size of the terminals and the size of the housing. Moreover, in order to press in and hold the terminals, it is necessary to increase a wall thickness of the housing between the terminals to securely hold the terminals when the terminals are arranged.

Accordingly, in the convention electrical connector disclosed in Patent Reference, it is necessary to increase the size of terminals and the size of the housing both in the fitting direction and the direction that the terminals are arranged.

In view of the above problems, an object of the invention is to provide an electrical connector capable of solving the problems of the conventional electrical connector. In the present invention, it is possible to reduce a size of the electrical connector both in a fitting direction thereof and a direction that terminals of the electrical connector are arranged in a housing thereof, while the housing holds the terminals with a sufficient force.

Further objects and advantages of the invention will be apparent from the following description of the invention.

SUMMARY OF THE INVENTION

In order to attain the objects described above, according to the present invention, an electrical connector includes a housing and terminals made of a sheet metal, which are held by the housing. The plurality of terminals is arranged in a direction perpendicular to a contact surface of a contact section thereof, and is held by the housing. Each of the terminals has a held section to be held by the housing, a contact section to contact with a mating terminal, and a connecting section to be connected to a circuit board each forming a flat sheet surface. The contact section is formed to have a flat contact surface, which slidably contacts with the mating terminal and extends in a connector fitting direction.

According to the present invention, in the electrical connector, the connecting section extends from the contact section in a direction to be away from the housing, i.e., a direction having a component perpendicular to the connector fitting direction. The held section is provided adjacent to the contact section on a side opposite to the extending direction of the connecting section. The held section is provided within a range of the contact section in the connector fitting direction, and held by the housing through an integral molding.

According to the present invention, the held section of each of the terminals held by the housing is provided within the range of the contact section in the connector fitting direction. Accordingly, the contact section has a maximum dimension in the connector fitting direction at a portion other than the connecting section. More specifically, a dimension of the held section does not become larger than that of the contact section in the connector fitting direction, so that it is possible to reduce a size of the terminal in the connector fitting direction. The housing for holding the terminals can also have a smaller size in the connector fitting direction.

According to the present invention, the held section of each of the terminals may be integrally molded with the housing, so that the housing holds each of the terminals at a circumferential surface of the held section thereof. Further, each of the terminals is held with a strong force due to the integral molding, so that it is not necessary to increase an area of the held section. In comparison with a conventional electrical connector, it is possible to reduce the size of the terminals. Even when it is necessary to increase an area of the held section, the held section may simply extend in the connector fitting direction and in a direction perpendicular to the terminal arrangement direction, so that it is not necessary to increase the dimension of the held section in the connector fitting direction.

According to the present invention, the held section of each of the terminals is held by the housing through the integral molding. Accordingly, it is possible to securely hold the terminals and it is possible to reduce a wall thickness of the housing between the terminals. Accordingly, it is possible to reduce the size of the electrical connector in the terminal arrangement direction.

According to the present invention, the contact section of each of the terminals may extend from in a direction away from the housing, i.e., in the direction having the component perpendicular to the connector fitting direction. Therefore, the connecting section of each of the terminals has the range overlapped with the contact section in the connector fitting direction. As a result, it is possible to reduce the size of the electrical connector in the connector fitting direction even in consideration of the connecting section in addition to the held section and the contact section.

As described above, according to the invention, the held section of each of the terminals is provided so as to be in the range of the contact section in the connector fitting direction. Further, the held section is held by the housing through the integral molding. Therefore, it is possible to reduce the size of the electrical connector in the connector fitting direction while securely holding the terminals. At the same time, it is possible to reduce the wall thickness of the housing between the terminals, and thereby it is possible to reduce the size of the connector in the terminal arrangement direction.

DETAILED DESCRIPTION OF PREFERRED EMBODIMENTS

Hereunder, referring to the accompanying drawings, embodiments of the invention will be described.

Figure 1:
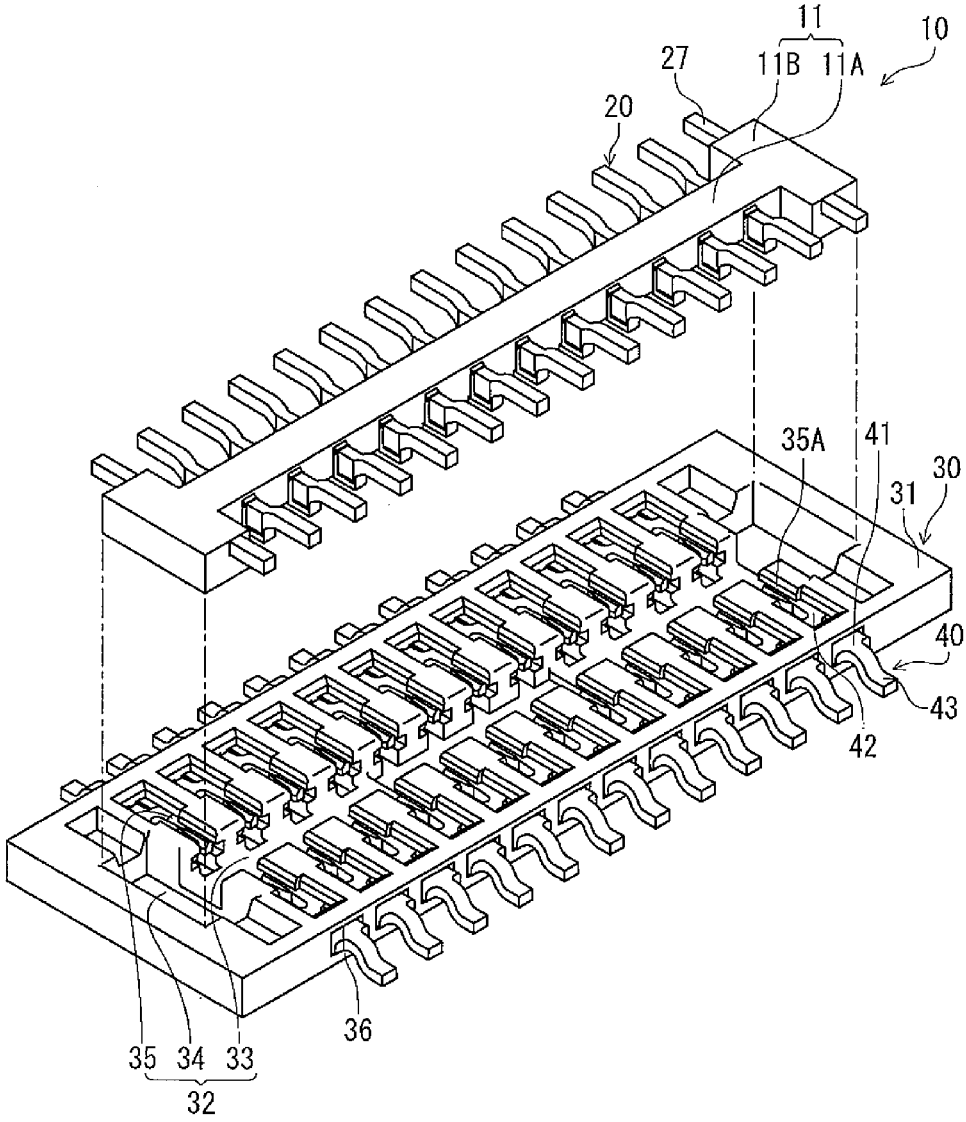
FIG. 1 is a perspective view showing a first connector and a second connector in a state right before the first connector is fit to the second connector according to an embodiment of the present invention.

In this embodiment, as shown in FIG. 1, there are provided a plug connector (hereinafter referred to as a first connector) 10 and a receptacle connector (hereinafter referred to as a second connector) 30, which are to be fitted and connected to each other. The connectors 10 and 30 are attached to corresponding circuit boards, and then fitted to each other, so that the circuit board surfaces are parallel to each other and the connector attaching surfaces face each other. Therefore, in the state of FIG. 1 that is right before the connector fitting, the first connector 10 is provided on a lower surface side of the corresponding circuit board, and the second connector 30 is provided on an upper surface side of the corresponding circuit board, and the first connector 10 and the second connector 30 face each other.

Figure 2:
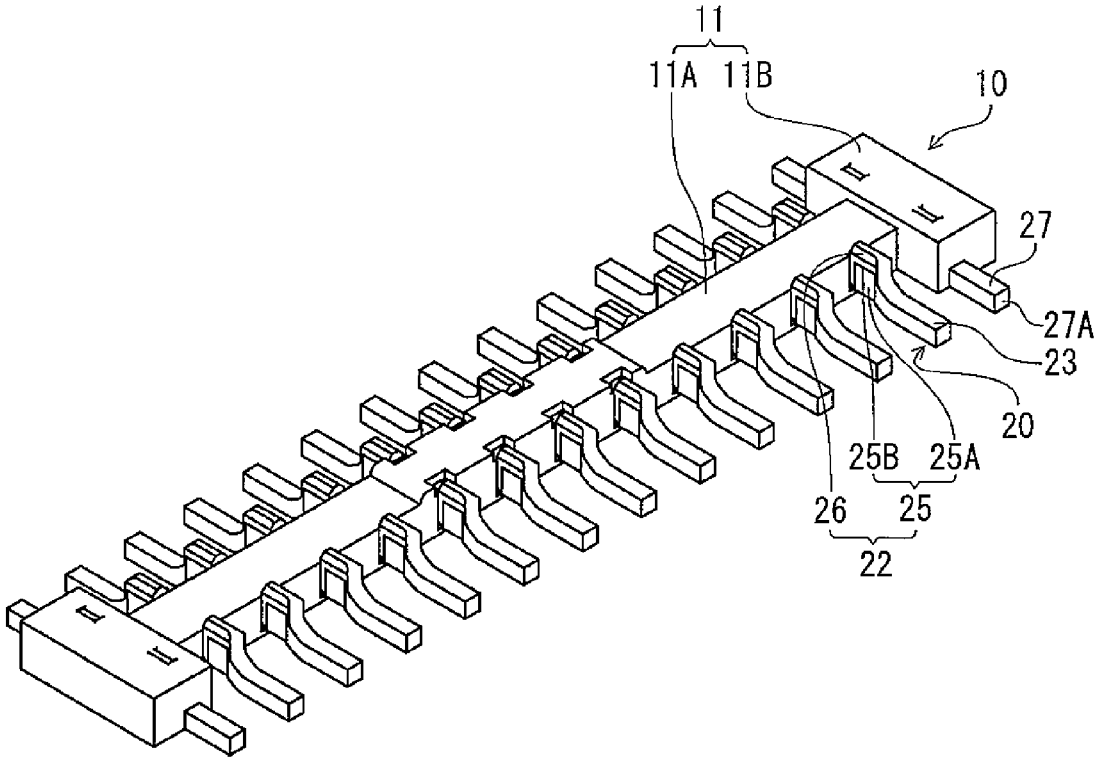
FIG. 2 is a perspective view showing the first connector in a state that the first connector is vertically flipped according to the embodiment of the present invention.

As shown also in FIG. 2 showing only the first connector 10, in which the first connector 10 is vertically flipped in relative to that in FIG. 1, which is right before connector fitting, first terminals 20 are held in a first housing 11 having a generally H-shape on its top view so as to extend towards the both sides.

The first housing 11 is made of an electrically insulating material, has a rod-like terminal held section 11A that extends long and has a quadrangle section, and metal fitting held sections 11B that project on the both sides from both ends of the terminal held section 11A in the longitudinal direction, and has a generally flat H-shape as a whole.

As also seen in FIG. 2, a plurality of first terminals 20 held by the first housing 11 is arranged at constant intervals in the longitudinal direction on both sides of the terminal held section 11A of the first housing 11. In the embodiment, the first terminals 20 arranged on the both sides have the same shape, and are symmetrically disposed in relative to the terminal held section 11A. Each first terminal 20 is obtained by forming an outer shape by punching sheet metal and denting a part of the sheet surface.

Figure 3:
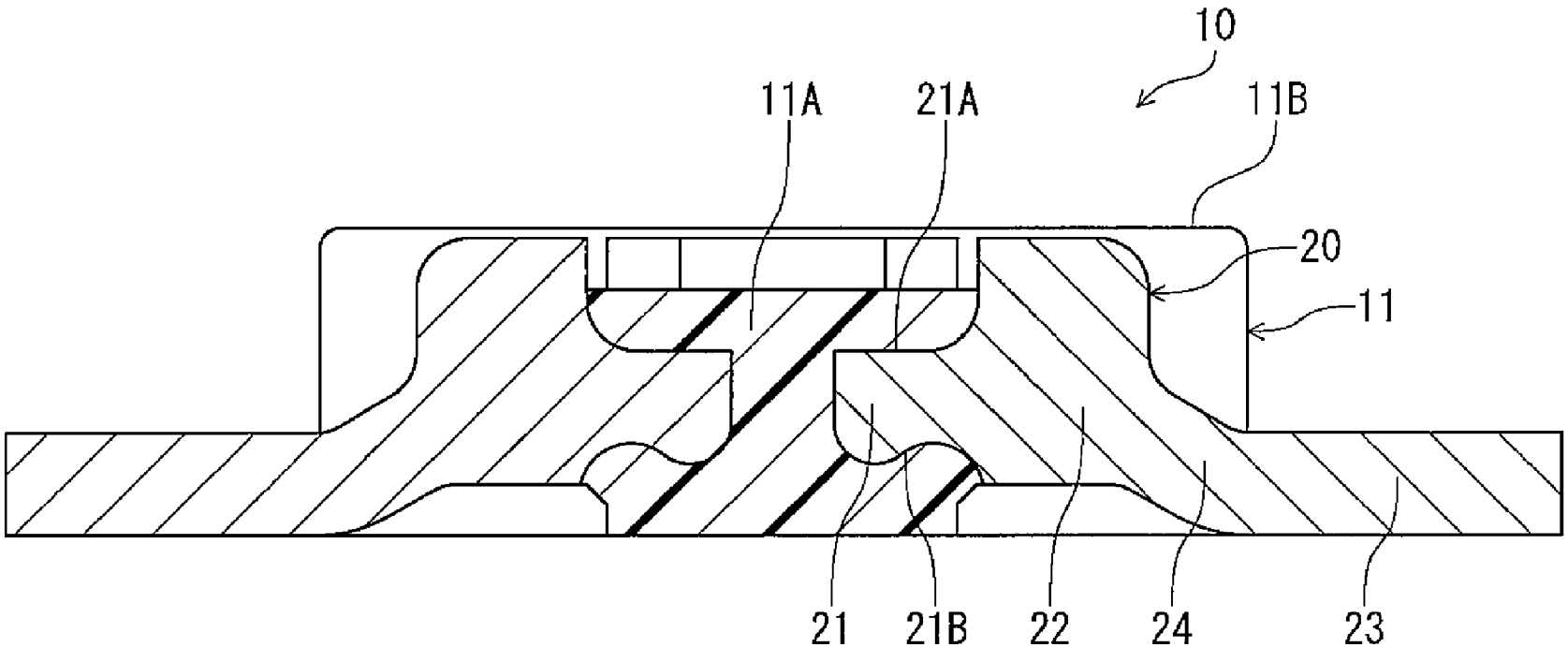
FIG. 3 is a sectional view showing the first connector taken along a plane where terminals thereof are arranged according to the embodiment of the present invention.
Figure 4:
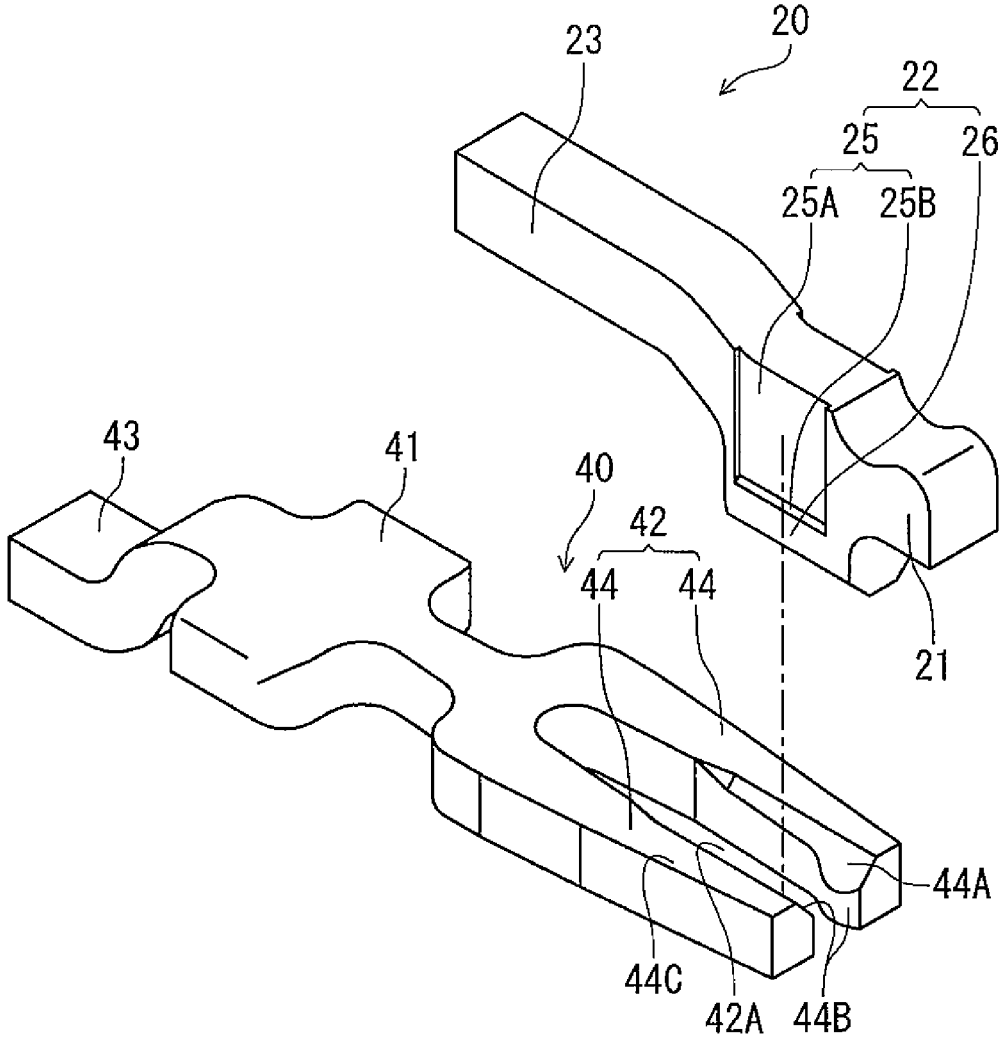
FIG. 4 is a perspective view showing a first terminal of the first connector and a second terminal of the second connector according to the embodiment of the present invention.

FIG. 2 shows a view, in which a plurality of the first terminals 20 held in the first housing 11 are exposed outside the first housing 11; FIG. 3 shows a cross-section of two first terminals 20 symmetrically held in the first housing 11, which is taken at a center in the sheet thickness direction of the first terminals 20; and FIG. 4 shows a view of one of the first terminals 20 in the same orientation as in FIG. 1 with the second terminal 40. The first terminal 20 has an outer shape when viewed in a direction perpendicular to the sheet surface (terminal arrangement direction), which is oblong extending sideward, which is a direction to be away from the terminal held section 11A of the first housing 11 in a direction horizontal to the circuit board surface to attach the first connector 10. Each first terminal 20 has three regions divided in the direction.

As shown in FIG. 3, those three regions are a first held section 21 to be held by the first housing 11 by integral molding to the first housing 11, a first contact section 22 that is provided outside the first housing 11 and contacts with the first contact section 22 to contact with a second terminal 40 of the second connector 30, and a first connecting section 23 that extends from the first contact section 22 and connects with a circuit board. There is a transitional section 24, which slightly tilts, between the first contact section 22 and the first connecting section 23, and this transitional section 24 may be optionally omitted.

More specifically, in a lateral direction, i.e. an extending direction of the terminals, the first held section 21, the first contact section 22, and the first connecting section 23 are formed in this order without overlapping to each other. And in the first terminal 20 in this embodiment, the first held section 21 held in the first housing 11 is within range of the first contact section 22 in the connector fitting (and pulling-out) direction, i.e. in the height (up-and-down) direction in the figure.

As can be understood well from FIG. 3, the first held section 21 is formed to protrude in the lateral direction from the first contact section 22 within the height range of the first contact section 22, and its upper edge forms a straight section 21A and its lower edge forms a wave-shaped section 21B. The first held section 21 is integrally molded while fully contacting by surface with the terminal held section 11A of the first housing 11 on the both sheet surfaces and a circumferential surface including the upper edge and the lower edge.

Accordingly, although the first held section 21 has a dimension within the height range of the first contact section 22, since the first held section 21 fully contacts with by face with a material of the terminal held section 11A and has the lower edge that is the wave-shaped section 21B, the first held section 21 is firmly held with the terminal held section 11A of the first housing 11 and has further enhanced resistance against external force in a direction of pulling out sideward.

As shown in FIGS. 1, 2, and 4, the first contact section 22 has a step-like recess 25 formed by denting a sheet surface of the terminal. As well shown in FIG. 4, this step-like recess 25 forms a contact surface 25A, which is formed to be a quadrangle region that is opened on the upper edge side of the first contact section 22 and has a step-like edge on the other three edges, and has a flat bottom surface to contact with the mating terminal, i.e., a second terminal. The step-like section of a lower edge of the step-like recess 25 in FIG. 4 forms a latching section 25B to latch to the second terminal. Below the latching section 25B, there is provided an introducing section 26 having a tapered surface to start contacting with the second terminal, and the contact surface 25A, the latching section 25B, and the introducing section 26 form a first contact section 22.

As well shown in FIGS. 2 and 3, the first connecting section 23 laterally extends via a transitional section 24 that tilts slightly downward in a direction to be away from the terminal held section 11A of the first housing 11. In the embodiment, the first connecting section 23 has about its half portion overlapped with the first contact section 22 in the height direction, i.e. connector fitting section.

When the first connector 10 is disposed on a circuit board, this first connecting section 23 is to be connected by soldering while contacting by face with a circuit section of the circuit board. Therefore, since the first connecting section 23 needs to have its lower edge be at the same surface level as or slightly below a bottom surface of the first housing 11, the first connecting section 23 is provided lower via the transitional section 24 that tilts from the first contact section 22.

However, the lower edge of the first contact section 22 may be provided lower than the position shown in FIG. 3 and be close to the bottom surface of the first housing 11, and the lower edge of the first contact section 22 may be provided elsewhere as long as it is at least slightly above the lower edge of the first connecting section 23. In this case, most part of the first connecting section 23 remains within range of the first contact section 22 in the height direction, and it is also possible to secure a large height dimension of the first contact section 22, i.e. a large contacting length with the mating terminal, i.e. the second terminal.

The metal fitting held sections 11B on the both ends of the first housing 11 hold attachment metal fittings 27. Similarly to the first terminals 20, the attachment metal fittings 27 are held by the first housing 11 by integral molding to the first housing 11, similarly to the first terminal 20.

Each attachment metal fittings 27 laterally extends from the metal fitting held section 11B, and a leg-like attaching section 27A extending therefrom has its lower edge at the same height level as the lower edge of the first connecting section 23 of the first terminal 20 so as to be able to attach to a corresponding attaching section of the circuit board by soldering similarly to the first connecting section 23.

As shown in FIG. 1 in which the first connector 10 right before fitting is also illustrated, in the second connector 30 to be fitted and connected to the first connector 10 of the embodiment described above, the second terminals 40 are arranged and held in the second housing 31 that has a rectangular flat shape as a whole.

Similarly to the first housing 11 of the first connector 10, the second housing 31 of the second connector 30 is made of an electrically insulating material, and has a receiving recess 32 to receive the first housing 11 of the first connector 10 and also the first terminals 20. The receiving recess 32 has a center recess 33 extending in a longitudinal direction so as to receive the terminal held section 11A of the first housing 11, end recesses 34 that extends in a lateral direction from the both ends in the longitudinal direction and receive the metal fitting sections 11B of the first housing 11, and further has a plurality of terminal recesses 35 that extends to have a comb-like shape from the both sides of the center recess 33 and holds the first contact sections 22 and the first connecting sections 23 of the first terminals 20 of the first connector 10.

Inner surfaces of the center recess 33 and the end recesses 34 have shapes to fit to the outer shapes of the receiving/mating sections, i.e. the terminal held section 11A and the metal fitting held sections 11B of the first connector 10.

As shown in FIG. 1, each terminal recess 35 has its groove width (distance between facing inner surfaces of the terminal recess 35 when viewed from thereabove) that varies in a direction perpendicular to the extending direction of the first terminal 20 depending on a position in the extending direction. The groove width of the terminal recess 35 is narrow in range that corresponds to the first contact section 22 of the first terminal 20 and wide in range that corresponds to the first connecting section 23.

In the range that corresponds to the first contact section 22, since the flat first contact section 22 enters the terminal recess 35, the groove width is large enough for such entry, i.e. enough width for the sheet thickness of the first contact section 22 that enters, and enough for guiding upon such entry, and has a terminal groove 35A having a tapered surface 35A at an upper edge of the entrance. On the other hand, in range in front thereof in the terminal extending direction, the width is larger since the first connecting section 23 of the first terminal 20 and solder enter therein.

The terminal recess 35 has a flat shape as described above, and the sectional shape of a surface extending in the fitting direction and the terminal arrangement direction will be described after describing the second terminal 40 since it is related to the second terminal 40.

As shown in FIG. 4, each second terminal 40 is made by forming an outer shape from sheet metal and bending in the sheet thickness direction. In addition, the second terminal 40 is made to receive the first contact section 22 of the first terminal 20 in a direction perpendicular to the sheet thickness surface.

The second terminal 40 that laterally extends has a second held section 41 in a middle part of the extending direction and has a second contact section 42 at one end provided corresponding to the first contact section 22 of the first terminal 20 on one side and a second connecting section 43 on the other end.

The second held section 41 is made to have a large width so as to be inserted and held in a corresponding holding hole of the second housing 31 as described below. A Y-shaped second contact section 42 extends on one end after a narrow section from the second held section 41. The second contact section 42 has its flat surface shape like a tuning fork, and has a groove section 42A opening towards one side and two contact arms 44 facing each other. The distance between two facing inner edges of the contact arms 44, i.e. the groove width, is narrower towards one ends (tips), i.e. free ends, and have tapered sections 44A on the upper edge section towards the inside of the groove.

At the tips, there are relatively round contact protrusions 44B formed to protrude in directions to become close to each other. The distance between the contact protrusions 44B is slightly smaller than that between the contact surfaces 25A of the step-like recess 25 on both sides formed on the first contact section 22 of the first terminal 20, i.e., the sheet thickness at the contact surface 25A. The two facing contact protrusions 44B are provided within range of corresponding contact surfaces 25A in the extending direction of the terminal as also seen in FIG. 4.

The second connecting section 43 is bent like a crank downward in the sheet thickness direction relative to the second held section 41, and then forms a surface parallel to the second held section 41.

As also shown in FIG. 1, such second terminal 40 has its second contact section 42 within the groove-like terminal recess 35 of the second housing 31, has the second connecting section 43 extend outside the second housing 31, and is held at the second held section 41 by the holding hole 36 of the second housing 31. The holding hole 36 communicates with the terminal recess 35 and is opened like a window on the side surface of the second housing 31. Once the second terminal 40 is inserted in the holding hole 36 through the opening from the second contact section 42 side, the second contact section 42 reaches the terminal recess 35, the second held section 41 is held by the holding hole 26, and the second connecting section 43 is located outside the second housing 31.

The terminal recess 35 is formed to have a slightly large groove width than the sheet thickness of the first contact section 22 of the first terminal 20 and a groove edge projecting section 35B projects inward of the groove. Right under the groove edge projecting section 35B, there is a restricting groove 37 formed extending the inner width of the holding groove 36 as is to a position to communicate with the center recess 33.

Figure 5:
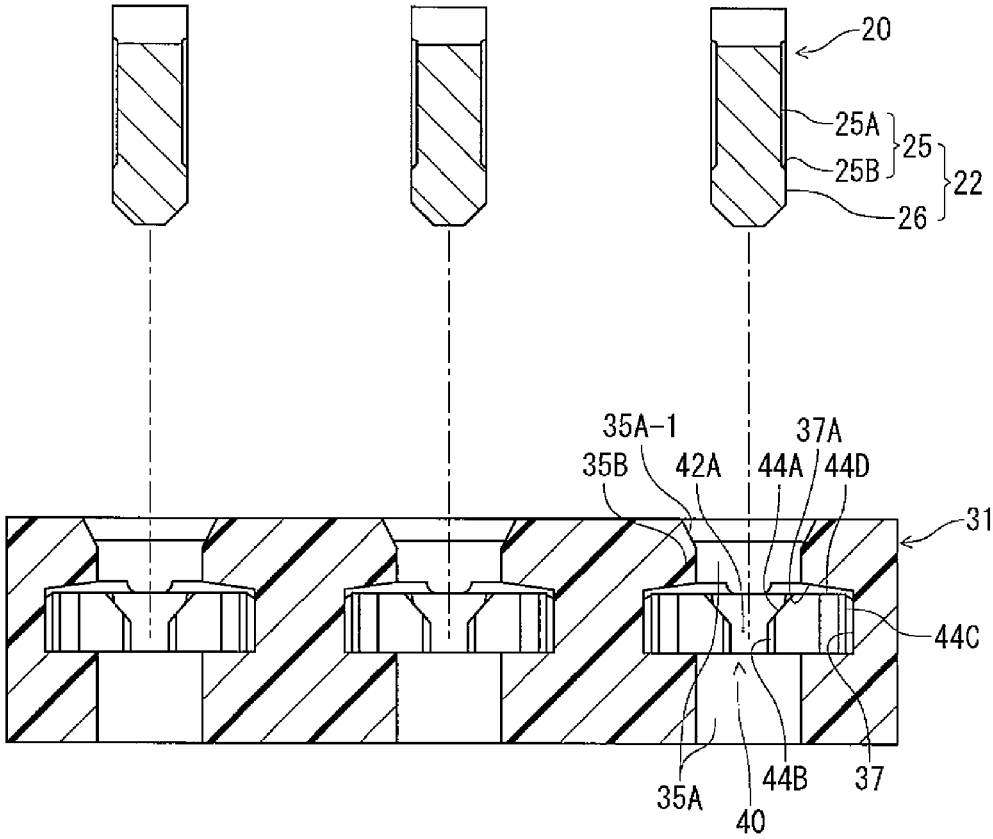
FIG. 5 is a sectional view showing the first terminal and the second terminal held in a second housing taken along a plane where contact sections of the first terminal and the second terminal in a direction that the terminals extend according to the embodiment of the present invention.
Figure 6:
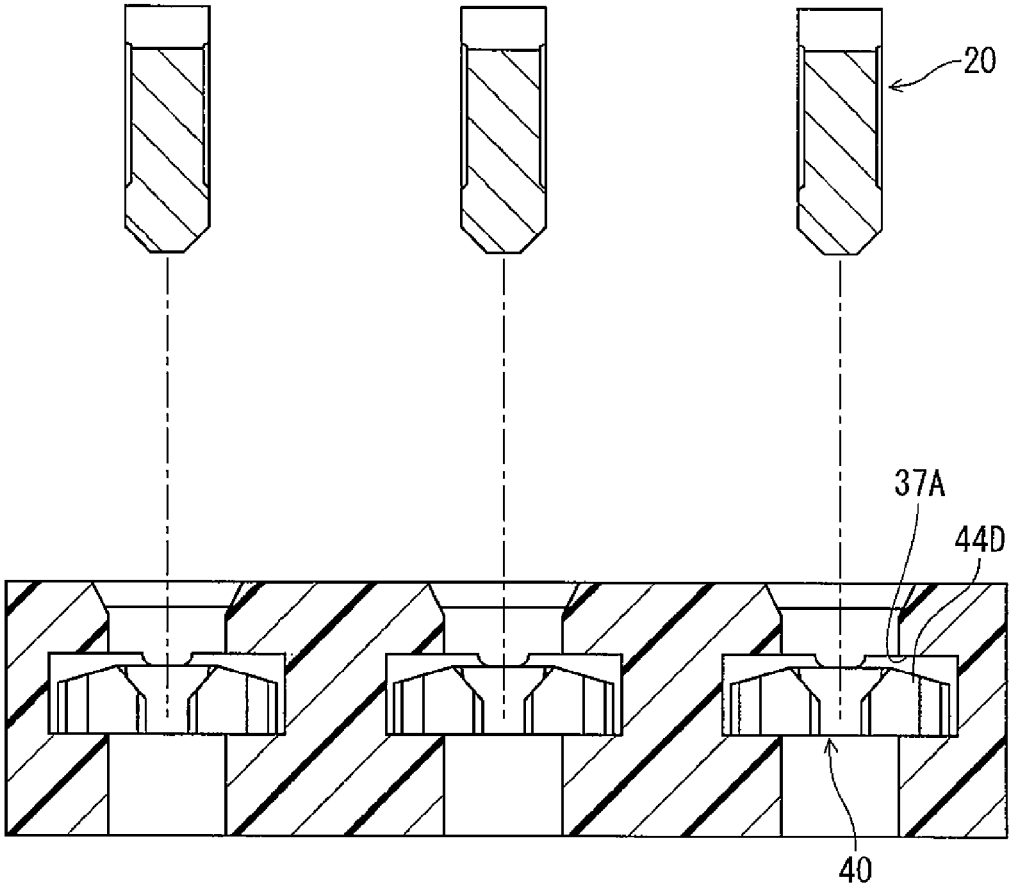
FIG. 6 is a sectional view showing a modified example of the electrical connector corresponding to FIG. 5 according to the embodiment of the present invention.

As shown in FIG. 5, each restricting groove 37 is formed on the inner surface side of the terminal groove 35A that is provided through in the up-and-down in the fitting direction, so as to open to the terminal groove 35A, and holds outer edges 44C of the two contact arms 44, which are the second contact sections 42 of the second terminal 40.

As shown in FIG. 5, the restricting groove 37 has its groove upper inner surface form a surface that tilts upward towards the terminal groove 35A, contacts to upper surfaces of the contact arms 44 of the second contact section 42 of the flat second terminal 40, so as to form a restricting section that restricts upward displacement of the contact arms 44.

Accordingly, an upper surface of each contact arm 44 that faces thereto forms a restriction receiving section 44D to receive restriction by the restricting section 37A. The restricting section 37A and the restriction receiving section 44D form actuating sections that contact to each other and there is component force generated at the actuating sections by the tilts of the restricting sections 37A in a direction to reduce the width of the groove section 42A of the second terminal 40.

Next, how to use and working principle of the two connectors of the embodiment will be described.

First, the first connector 10 and the second connector 30 are respectively connected and attached to corresponding circuit boards. In FIG. 1 showing the both connectors 10 and 30 right before fitting, the circuit boards are omitted, but as already described above, a corresponding circuit board is provided on an upper surface side of the first connector 10, a corresponding circuit board is provided on a lower surface side of the second connector 30, and those connectors are provided to face each other. In other words, as for the first connector 10, after disposing the first connector 10 in the attitude shown in FIGS. 2 and 3 on a circuit board and attaching thereto, the first connector 10 is vertically flipped so as to take the attitude of FIG. 1.

In the position and attitude of FIG. 1, the first connector 10 attached to the circuit board is descended to fit to the second connector 30. Upon fitting, being guided by the tapered surface (35A-1) of each groove edge projecting section 35B, the first housing 11 of the first connector 10 is received by the receiving recess 32 of the second housing 31 of the second connector 30, and the first contact section 22 of the first terminal 20 of the first connector 10 advances into the terminal recess 35 being guided by the tapered surfaces 35A-1 to the terminal groove 35A of the second housing 31.

As shown in FIG. 5, inside each terminal groove 35A, the contact protrusion 44B of the contact arm 44 of the second connector 30, in which an outer edge 44C is housed in the restricting groove 37 formed being opened to the facing inner surface, and the groove section 42A formed between the contact arms 44 is provided right under the first contact section 22 of the first terminal 20. An lower end of each first contact section 22 is formed as an introducing section 26 having a tapered surface, and the first contact section 22 has its introducing section 26 being guided by the tapered section 44A formed on an upper edge of the groove section 42A of the contact arm 44 and elastically displaces the contact arms so as to push away from each other with the contact protrusion 44B and widens the groove width of the groove section 42A.

Furthermore, when the advancement of the first contact section 22 to the groove section 42A progresses, the introducing section 26 passes the position of the contact protrusion 44B and the step-like recess 25 comes to contact with the contact protrusion 44B. In other words, in view from the contact protrusion 44B, each contact protrusion 44B moves relatively to the first contact section 22, moves over the introducing section 26, and reaches the flat contact surface 25A via the step-like latching section 25B. Then, the contact protrusion 44B keeps the state of contacting with the contact surface by certain contact pressure with the elastic displacement reduced for a height difference at the latching section 25B.

After fitting and connecting the first connector 10 to the second connector 30 as described above, if unexpected force is applied to the first connector 10 in a pulling-out direction, the step-like latching section 25B formed on the first contact section 22 of each first terminal 20 and the contact protrusion 44B of the second connector 30 latch to each other in the pulling-out direction and prevent the connector 10 from coming off. If the force in the pulling-out direction is unexpectedly large, the latching section 25B elastically displaces the contact protrusion 44B upward so as to come off from the latching.

In the embodiment, there is a tapered restricting section 37A formed on a groove upper inner surface of the restricting groove 37 of the second housing 31, and the restriction receiving section 44D that faces the restricting section 37A, which is formed on an upper surface of the contact arm 44 of the second contact section 42.

Therefore, even if the contact arm 44 receives the force in the pulling-out direction via the latching section 25B and elastically displaces upward, the restriction receiving section 44D contacts to the restricting section 37A before coming off from the latching and the two contact arms 44 elastically displace in a direction to reduce the groove width of the groove section 42A by lateral component force of the reaction force from the tapered surfaces of the restricting sections 37A Further, the contact protrusions 44B of the two contact arms 44 enhance the tight cramping force on the contact surfaces 25 on the both sides of the first contact section 22. As a result, the first contact section 22 cannot move in the direction of most quickly pulling out, so that the latching with the contact protrusions 44B at the step-like latching sections 25B would not come off.

It should be noted that the invention will not be limited by those embodiments shown in FIGS. 1 through 5 and may be varied, modified, and/or altered in many ways.

For example, as for the restricting sections 37A of the second housing 31 and the restriction receiving sections 44D of each second terminal 40 in the second connector 30, each restricting section 37A does not have to have a tapered surface as in the embodiment of FIG. 5, and alternatively, each restricting section 37 may be formed as a flat surface and the restriction receiving section may be formed as a tapered surface.

Furthermore, the restricting sections and the restriction receiving sections may not have to be tapered surfaces that are tilted straight, but may be formed by curved surfaces that tilt at least portions that contact to each other.

Figure 7:
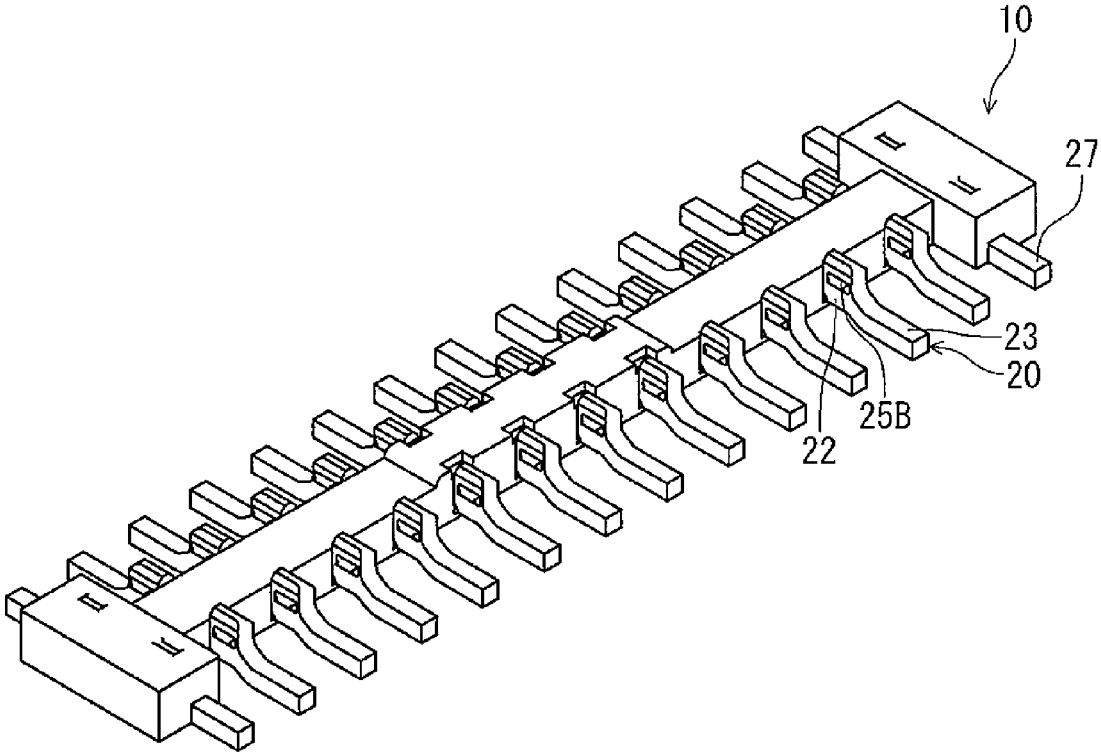
FIG. 7 is a perspective view showing a modified example of the first connector according to the embodiment of the present invention.

Next, each latching section 25B provided on the first terminals 20 of the first connector 10 may not have to be the step-like edge section of the step-like recess 25 as shown in FIGS. 2 and 4, but the latching section 25B may be formed as a protrusion shown in FIG. 7.

Figure 8:
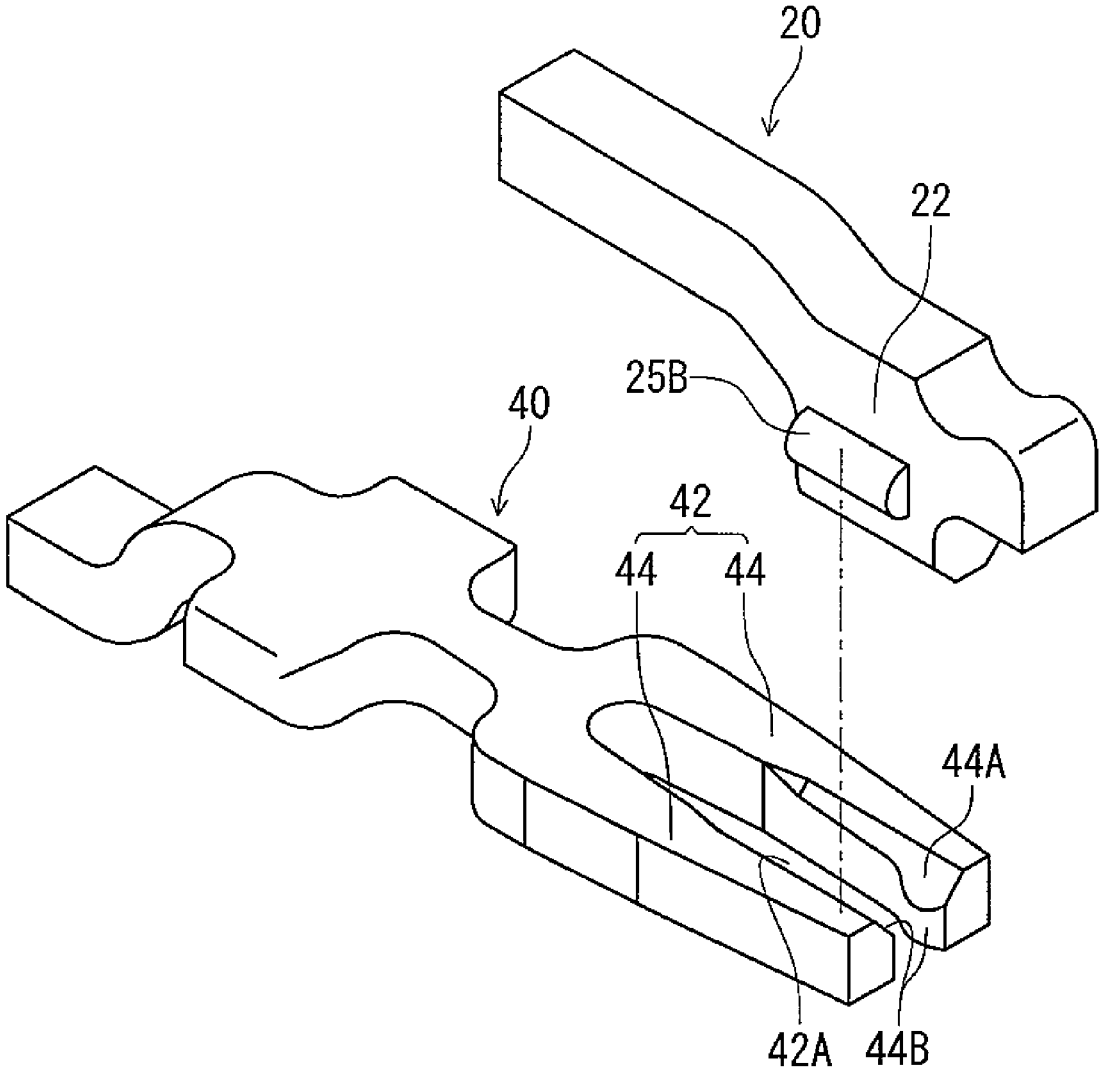
FIG. 8 is a perspective view showing a first terminal and a second terminal of the modified example of the first connector according to the embodiment of the present invention.

As shown in FIG. 8, each contact protrusion 44B of the second terminal 40 of the second connector 30 moves over the latching section 25B formed as a protrusion and latches with the latching section 25B so as to prevent the connector form coming off.

In the invention, the latching sections 25 may not have to be essentially included, and the first contact sections 22 may be formed as flat surfaces.

The disclosure of Japanese Patent Application No. 2010-190696, filed on Aug. 27, 2010 is incorporated in the application by reference.

While the invention has been explained with reference to the specific embodiments of the invention, the explanation is illustrative and the invention is limited only by the appended claims.

What is claimed is:

1. An electrical connector to be connected to a mating connector in a connecting direction, comprising:

a housing; and a terminal disposed in the housing, said terminal including a held section to be held with the housing, a contact section for contacting with a mating terminal of the mating connector, and a connecting section to be connected to a circuit board, said connecting section being extending from the contact section in a first direction perpendicular to the connecting direction, said held section being situated adjacent to the contact section on a side opposite to the connecting section and within a length of the contact section in the connecting direction.

2. The electrical connector according to claim 1, wherein said terminal is arranged at a plurality of locations arranged in a second direction perpendicular to the connecting direction and the first direction.

3. The electrical connector according to claim 1, wherein said contact section includes a contact surface extending in the connecting direction.

4. The electrical connector according to claim 1, wherein said connecting section is situated within the length of the contact section in the connecting direction.

* * * * *